United States Patent [19]

Strain

[11] 4,449,965

[45] May 22, 1984

[54] SHELL TYPE CENTRIFUGE ROTOR HAVING CONTROLLED WINDAGE

[75] Inventor: David H. Strain, Los Gatos, Calif.

[73] Assignee: Beckman Instruments, Inc., Fullerton, Calif.

[21] Appl. No.: 432,488

[22] Filed: Oct. 4, 1982

[51] Int. Cl.[3] ..... B04B 5/02

[52] U.S. Cl. ..... 494/16

[58] Field of Search ..... 494/16, 21, 31; 206/815, 37; 220/23.4, 23.83

[56] References Cited

U.S. PATENT DOCUMENTS

| | | | |
|---|---|---|---|
| 650,529 | 5/1900 | Eggeman . | |
| 1,730,776 | 10/1929 | Lundgren . | |
| 3,154,827 | 11/1964 | Gentry | 206/815 X |
| 3,233,825 | 2/1966 | Lomb | 233/24 |
| 3,720,368 | 3/1973 | Allen | 494/16 |
| 4,057,148 | 11/1977 | Meyer et al. | 494/16 X |
| 4,221,325 | 9/1980 | Kubota | 494/16 X |
| 4,310,488 | 1/1982 | Rahm et al. | 220/23.4 X |

FOREIGN PATENT DOCUMENTS

| | | | |
|---|---|---|---|
| 2201542 | 4/1973 | Fed. Rep. of Germany | 494/16 |
| 2437996 | 10/1978 | France | 206/815 |
| 2098516 | 4/1981 | United Kingdom | 494/16 |

OTHER PUBLICATIONS

Catalog Sheet Found in USPTO Examiner File Div. 55, Date Stamped May 25, 1954, Which Shows Several Centrifuges Marketed Under the Tradename "Servall."

*Primary Examiner*—Robert W. Jenkins

*Attorney, Agent, or Firm*—R. J. Steinmeyer; F. L. Mehlhoff; A. A. Canzoneri

[57] ABSTRACT

The present invention is directed to a shell type centrifuge rotor formed as a frustoconical shell having a circular rim adjacent at least one end thereof. The lower end of the shell is open, whereas the upper end has a conical recess and a central opening. The recess has an inverted frustoconical sidewall, with a plurality of apertures equally spaced therein and disposed an equal distance from the central opening.

A tube holder is mounted in each of the apertures for receiving a centrifuge test tube. The tube holder has a flange configured so as to fit the surface contour of the conical recess so that the flange fully contacts the wall of the conical recess when the tube holder is mounted in the aperture. A hub is mounted in the central opening of the conical recess and couples the frustoconical shell to the centrifuge drive shaft. Means are secured to the hub for partially enclosing the lower end of the frustoconical shell to reduce the windage of the rotor to a predetermined level.

6 Claims, 6 Drawing Figures

SHELL TYPE CENTRIFUGE ROTOR HAVING CONTROLLED WINDAGE

BACKGROUND OF THE INVENTION

The present invention relates to apparatus for centrifugation and more particularly to improvements in centrifuge rotors.

Centrifuge rotors made in the form of a thin walled structure or hollow shell are well known in the centrifuge art. Many early centrifuge rotors were constructed of sheet metal and were designed to hold a plurality of sample containing test tubes. The development of modern high-speed centrifuges initiated a trend toward the use of high strength solid rotors machined from solid bars or forgings. There remains today, however, a class of moderate speed table top size analytical centrifuges which are suited to the use of shell-type rotors. In such applications, a shell-type rotor provides adequate structural strength and can be manufactured more economically than a solid machined rotor.

In its simplest form, a shell rotor may be constructed of only two pieces, a formed rotor body or "shell" and a hub which serves to couple the shell to a drive shaft. In such an arrangement the bottom end of the shell is open, thereby presenting at least two significant disadvantages.

A first disadvantage of a shell type rotor having an open bottom is that it has greater windage than a closed or solid rotor. Thus, for a given driving force, an open shell rotor cannot achieve as high a rotating speed. This is an important consideration in centrifuges having fixed or preset speed settings, especially where it is desired to employ various rotor types interchangeably.

The windage problem which has been described cannot be remedied satisfactorily by simply providing a closed bottom to transform an open shell rotor into a closed shell rotor. While it is true that a closed shell rotor would have windage characteristics generally similar to a solid rotor, it is not comparable in terms of mass and inertia. As a consequence, a closed shell rotor tends to accelerate more rapidly and reaches a higher speed than a solid rotor of similar size. Predictable centrifugation operations with mixed rotor types cannot be carried out, therefore, unless some type of electronic or mechanical speed sensing and governing means are employed. To control both the parameters of acceleration and steady state speed requires a fairly high level of complexity in the control apparatus which is undesirable from the standpoint of its cost and ultimate reliability.

A second disadvantage of an open shell rotor is that in order to use conventional centrifuge tubes, a tube holder must be employed to contain the tubes in the rotor. This is particularly true in the case where such tubes are made of glass and subject to breakage under the stress of centrifugal forces. In many small centrifuges, the drive system is not protected against the entrance of fluids and any spillage occurring in the rotor chamber may damage the drive system. In addition, it is not uncommon in the design of small centrifuges to rely upon the fan effect of the rotor to provide a cooling air stream to the motor. In such cases, openings may be provided in the rotor chamber to duct air to the motor, and thus the need for precautions against fluid spillage is obvious.

Accordingly, it will be seen that there is a need for improvement in centrifugation apparatus which is provided by the present invention as set forth hereinafter.

SUMMARY OF THE INVENTION

The present invention is directed to a shell type centrifuge rotor formed as a frustoconical shell having a circular rim adjacent at least one end thereof. The lower end of the shell is open, whereas the upper end has a conical recess and a central opening. The recess has an inverted frustoconical sidewall, with a plurality of apertures equally spaced therein and disposed an equal distance from the central opening.

A tube holder is mounted in each of the apertures for receiving a centrifuge test tube. A hub is mounted in the central opening and couples the frustoconical shell to the centrifuge drive shaft. Means are secured to the hub for partially enclosing the lower end of the frustoconical shell to reduce the windage of the rotor to a predetermined level. In one form of the invention the means for reducing the windage of the rotor comprises a circular plate having a hole through its center and an outside diameter smaller than the opening in the lower end of the shell. The outside diameter is selected so that during rotation of the rotor the plate reduces the windage of the rotor to a predetermined level.

In another form of the invention, the means for reducing the windage of the rotor comprises a circular plate having a hole through its center and an outside diameter smaller than the opening in the lower end of the shell and a plurality of notches spaced about the periphery of the plate. The notches are each centered below the lower end of a tube holder and thereby provide access to enable the tube holder to be pushed out of the aperture in which it is seated when removal of the tube holder from the aperture is desired. The outside diameter of the plate is selected so that during rotation of the rotor the plate reduces the windage of the rotor to a predetermined level.

The invention also provides a tube holder for mounting in an aperture in the wall of a shell-type centrifuge rotor. The tube holder is in the form of a rigid tubular body closed at one end and having a flange at the other end. The underside of the flange is configured so as to fit the surface contour of the conical sidewall so that the flange fully contacts the conical sidewall when the tube holder is mounted in the aperture. The tubular body has a ridge encircling its outer perimeter and the ridge is made slightly larger than the aperture. The ridge is located adjacent the inward surface of the conical sidewall when the tube holder is mounted in the aperture, thereby holding the tube holder captive against inadvertent withdrawal from the aperture. The flange of the tube holder has an outline configuration corresponding to a circular ring sector.

DESCRIPTION OF THE PREFERRED EMBODIMENTS

Figure 1A:
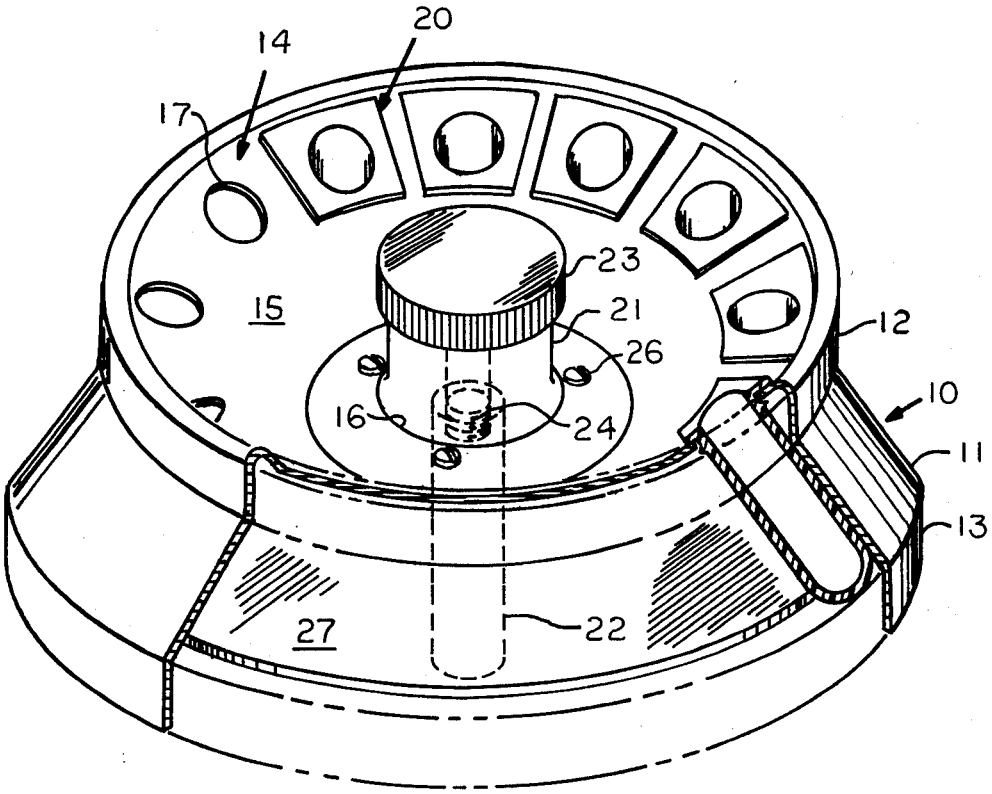
FIG. 1*a* is a perspective view of a rotor constructed in accordance with the present invention.
Figure 1B:
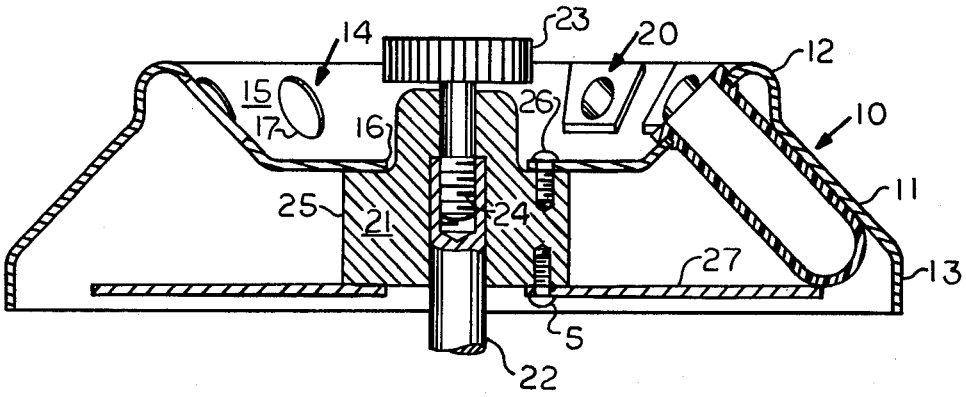
FIG. 1*b* is a cross-sectioned elevation view of the rotor shown in FIG. 1*a*.

As shown by FIGS. 1*a* and 1*b*, a shell rotor constructed in accordance with the present invention is generally denoted by reference number 10. The rotor 10 is formed as a frustoconical shell 11 having adjacent its upper and lower ends circular rims 12 and 13 respectively. The lower end of shell 11 is open and the upper end has a coaxial recess denoted in general by reference numeral 14. The recess 14 has a central opening 16 and an inverted frustoconical sidewall 15. The sidewall 15 contains a plurality of apertures 17 equally spaced and disposed an equal distance from the central opening 16.

A tube holder 20 adapted to receive a centrifuge test tube (not shown in FIGS. 1*a* and 1*b*) is mounted in each aperture 17. The rotor of FIGS. 1*a* and 1*b* is shown without a full complement of tube holders 20 for purposes of illustration. However, in use, it is desirable to load the rotor evenly to maintain rotor balance. The tube holders are more fully described elsewhere hereinafter.

Still referring to FIGS. 1*a* and 1*b*, a hub 21 is mounted in the central opening 16 and serves to couple the rotor 10 to a drive shaft 22. The hub 21 is secured to the drive shaft 22 by means of a screw 24 having on one end a knurled knob 23 and the other end engaging screw threads in the end of the drive shaft 22. The hub 21 has a flange 25, the upper face of which is abutted by the shell 11 and secured thereto by screws 26.

The open underside of shell 11 is partially enclosed by a circular plate 27 affixed to the lower face of the flange 25 by a plurality of screws 5. The circular plate 27 serves to reduce the windage of the open shell rotor. The outer diameter of the circular plate 27 is selected so that the windage is reduced to a predetermined level. Thus, by controlling the windage of the rotor 10, the acceleration and deceleration characteristics, as well as the top speed of the rotor, can be tailored to match those of other type rotors used on a given centrifuge. This is advantageous, first in that the shell-type rotor is more economical to manufacture than other types and second that the speed controlling is accomplished without resort to expensive mechanical or electrical speed governing apparatus.

Figure 2:
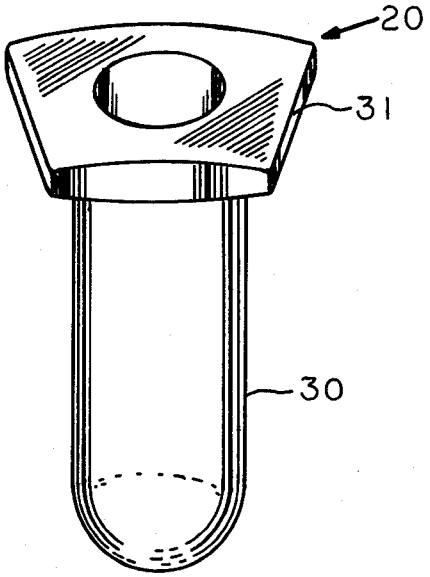
FIG. 2 is a perspective view of a tube holder having a circular ring sector shaped flange and employed in the rotor of the present invention.
Figure 3:
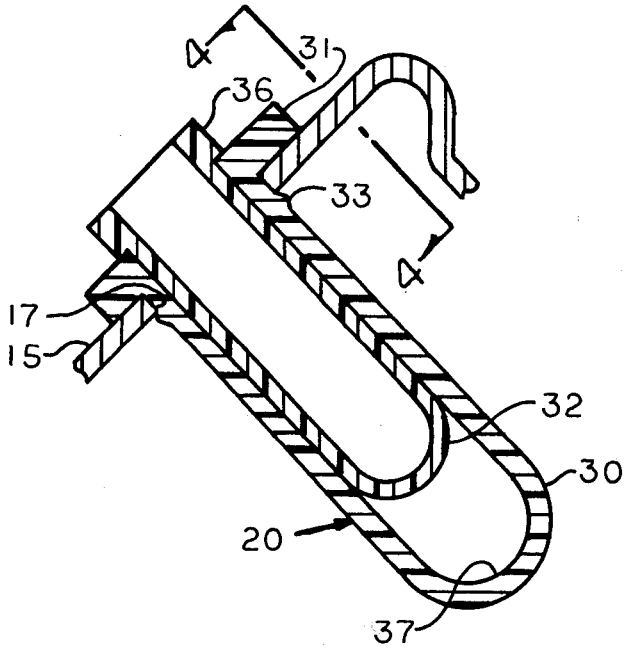
FIG. 3 is a cross sectional view of the tube holder of the invention with a centrifuge tube positioned therein.
Figure 4:
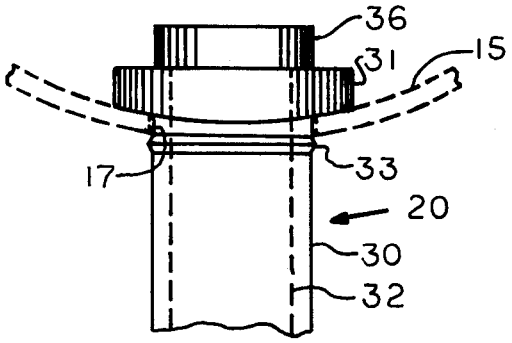
FIG. 4 is a fragmentary side view of the tube holder of the invention taken on the line 4—4 of FIG. 3 and showing the side of the circular ring sector-shaped flange having the largest radius.

In FIGS. 2–4, the tube holder 20 is shown from a number of different vantage points. Referring to FIG. 2 the tube holder 20 is shown in a perspective view, wherein it will be seen that the tube holder 20 has a rigid tubular body 30 which is closed at one end and has a flange 31 at the other end. The flange 31 has an outline configuration corresponding to a circular ring sector. The straight sides of the sector form an angle of 20° and the sides formed by the long and short arcs of the sector have radii of 1.87 and 1.36 inches respectively. The sector shape of the flange 31 is advantageous in that it provides a relatively large area in contact with the rotor. Also, the shape of the flange assures that the tube holder will be properly oriented when mounted in the aperture 17. Proper orientation of the tube holder is highly important in order to achieve even load distribution, since the under surface of flange 31 is contoured to match the contour of the mounting surface (sidewall 15) as will be discussed elsewhere hereinafter.

In FIG. 3, the tube holder 20 is shown containing a centrifuge tube 32 and is shown mounted in aperture 17 of the sidewall 15. The tubular body 30 will be seen to have a ridge 33 encircling its outer perimeter. The ridge 33 is located adjacent the inward surface of the rotor sidewall 15 when the tube holder is mounted in the aperture 17. The ridge 33 is made slightly larger than the aperture 17, thereby requiring that some degree of force be used in seating the tube holder in the aperture. The ridge 33 serves to hold the tube holder captive against inadvertent withdrawal from the aperture. Ideally, the force required to seat (or unseat) the tube holder in the aperture is in the nature of a moderately hard push with the fingers of the hand so as to make the ridge 33 "snap" through the aperture.

A centrifuge tube 32 is shown positioned in the tube holder 20 of FIGS. 3 and 4. The centrifuge tube 32 is shown to be supported by its rim 36 resting against the tube holder flange 31. It will be understood that the centrifuge tube depicted represents but one variety of many such tubes currently in use, and that other tube forms may be accommodated by the tube holder 20 with equal effectiveness. For example, a tube of another form may be longer and thereby rest against the bottom 37 of the tube holder cavity instead of being supported from its rim. Similarly, the tube holder 20 may be made to accommodate tubes of larger and smaller diameters than the tube shown. A major service of the tube holder 20 is to contain the centrifugation sample in the event that centrifuge tube 32 breaks. Containment of the centrifuge sample is a necessary precaution when operation takes place in a centrifuge not having a sealed rotor chamber, and is highly desirable also from the standpoint of preventing contamination of the rotor chamber or of other samples undergoing centrifugation.

Referring now to FIG. 4, the test tube holder 20 is shown in a fragmentary side view taken on the line 4—4 of FIG. 3. For clarity of illustration, the sidewall 15 of the rotor is shown as a dotted line cross-section. The tube holder 20 is shown seated in aperture 17. It will be noted also that the underside of flange 31 is configured to fit the surface contour of sidewall 15 so that the underside of the flange fully contacts the sidewall when the tube holder 20 is mounted in the aperture 17. Full contact between the flange and sidewall assures even distribution of load forces, thereby preventing premature structural failure of the tube holder.

In the preferred form, the rotor shell and circular plate are constructed of sheet metal such as sheet aluminum, 0.065 inches thick. There is, however, no impediment to making the rotor and circular plate from other materials such as stainless steel or various nonmetallic materials such as polyester/glass or as an epoxy/carbon fiber composite and the like. Similarly, in the preferred form, the tube holder 20 is molded of a glass-filled polyester material which provides such desirable properties as chemical resistance, light weight, high strength and low cost. It will, however, be obvious to anyone knowledgeable in the centrifuge art that the tube holder could also be made of metal and produced by a diecasting process. This alternative construction, however, would likely forego some of the advantages previously enumerated for the preferred mode.

Figure 5:
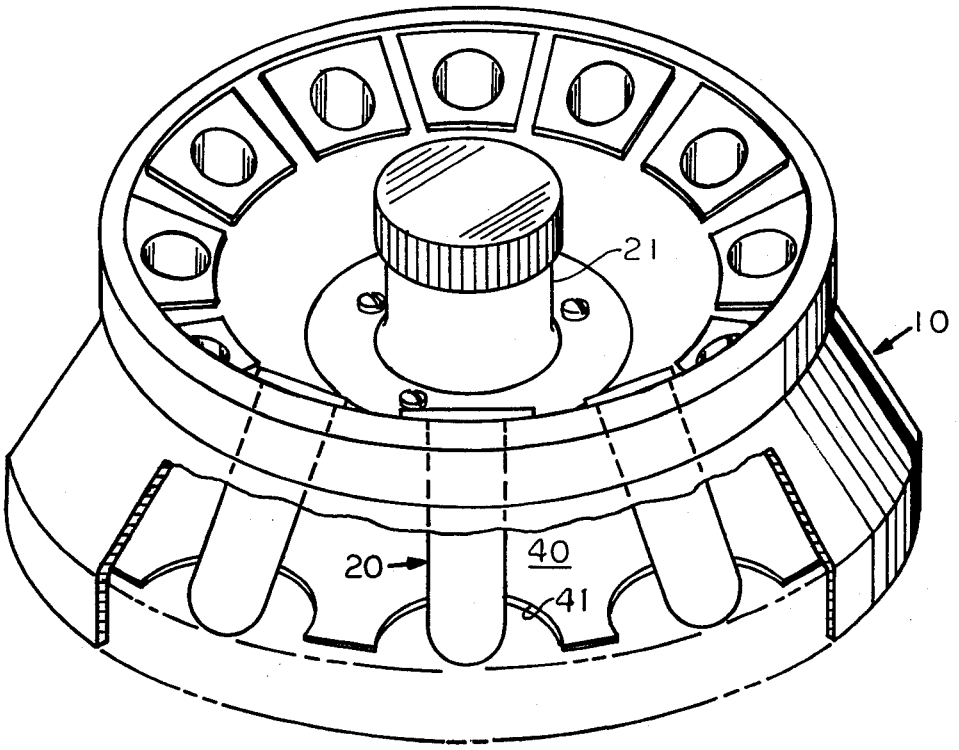
FIG. 5 is a perspective view of a rotor of the present invention in an alternate form thereof.

Referring now to FIG. 5, the circular plate 40 is shown in an alternate embodiment. In the form shown, the plate 40 has a central hole (not shown) and is secured to the hub as in the first-described embodiment thereof. In the alternate form, however, the plate 40 has a plurality of notches 41 spaced about its periphery, wherein each such notch 41 is centered about the lower end of a tube holder 20. In this way, the notch provides access to enable the tube holder to be pushed out of the aperture in which it is mounted by the pushing with fingers of the hand when removal of the tube holder from the rotor is desired. The outside diameter of the plate 40 is made somewhat larger than the version not having the notches 41. The outside diameter is selected so that during rotation of the rotor the plate 40 reduces the windage of the rotor to a predetermined level.

While in accordance with the patent statutes there has been described what at present is considered to be the preferred embodiments of the invention, it will be understood by those skilled in the art that various changes and modifications may be made therein without departing from the invention and it is, therefore, the aim of the appended claims to cover all such changes and modifications as fall within the true spirit and scope of the invention.

What is claimed is:

1. A shell-type centrifuge rotor comprising:

a frustoconical shell having a circular rim adjacent at least one end thereof, the lower end of said shell being open and the upper end having a coaxial recess and central opening, said recess having an inverted frustoconical sidewall, said sidewall having a plurality of apertures equally spaced and disposed an equal distance from said central opening;

a tube holder mounted one in each of said apertures for receiving a centrifuge test tube;

a hub, said hub mounted in said central opening and adapted for coupling said frustoconical shell to a drive means; and means secured to said hub for partially enclosing the lower end of said frustoconical shell to reduce the windage of said rotor to a predetermined level.

2. The shell-type centrifuge rotor defined in claim 1, wherein said means for reducing the windage of said rotor comprises:

a circular plate having a central hole therethrough;

said plate having an outside diameter smaller than said opening in the lower end of said shell;

said outside diameter selected so that during rotation of said rotor said plate reduces the windage of said rotor to a predetermined level.

3. The shell-type centrifuge rotor defined in claim 1, wherein said means for reducing the windage of said rotor comprises:

a circular plate having a central hole therethrough;

said plate having an outside diameter smaller than said opening in the lower end of said shell;

said plate having a plurality of notches spaced about its periphery, said notches centered one below the lower end of each said tube holder and thereby providing access to enable said tube holder to be pushed out of said aperture when its removal is desired;

said outside diameter selected so that during rotation of said rotor said plate reduces the windage of said rotor to a predetermined level.

4. A centrifuge rotor comprising, in combination:

a frustoconical shell having a circular rim adjacent at least one end thereof;

the lower end of said shell being open and the upper end having a coaxial recess and central opening, said recess having an inverted frustoconical sidewall, said sidewall having a plurality of apertures equally spaced and disposed at equal distance from said central opening;

a hub mounted in said central opening, said hub adapted for coupling said frustoconical shell to a driving means;

means secured to said hub for partially enclosing the lower end of said frustoconical shell to reduce the windage of the rotor to a predetermined level;

a plurality of tube holders mounted one in each aperture of said sidewall for receiving a centrifuge test tube;

each tube holder having a rigid tubular body closed at one end and having a flange at the other end;

said flange having a contour on its underside corresponding to a portion of a right circular cone.

5. The combination defined in claim 4 wherein said tubular body having a ridge encircling its outer perimeter, said ridge being slightly larger than said aperture, and said ridge being located against the inward surface of said sidewall when said tube holder is mounted in said aperture, and holding said tube holder captive against inadvertent withdrawal from said aperture.

6. The combination defined in claim 4 or claim 5 wherein said flange having a peripheral outline corresponding to a circular ring sector.

* * * * *